US009567147B2

(12) United States Patent
Park

(10) Patent No.: US 9,567,147 B2
(45) Date of Patent: Feb. 14, 2017

(54) DUAL COMPARTMENT POUCH HAVING PRESSURE-OPENABLE NON-SEAMED LINE

(71) Applicant: C&TECH CORPORATION, Hwaseong (KR)

(72) Inventor: Han-Wook Park, Seoul (KR)

(73) Assignee: C&TECH CORPORATION, Hwaseong-si (KR)

( * ) Notice: Subject to any disclaimer, the term of this patent is extended or adjusted under 35 U.S.C. 154(b) by 0 days.

(21) Appl. No.: 14/880,841

(22) Filed: Oct. 12, 2015

(65) Prior Publication Data

US 2016/0114960 A1 Apr. 28, 2016

(30) Foreign Application Priority Data

Oct. 28, 2014 (KR) ..... 10-2014-0147753

(51) Int. Cl.

| | |
|---|---|
| ***B65D 25/08*** | (2006.01) |
| ***B65D 81/32*** | (2006.01) |
| *B65D 51/28* | (2006.01) |
| *B65D 75/52* | (2006.01) |
| *B65D 75/56* | (2006.01) |

(52) U.S. Cl.

CPC ..... *B65D 81/3266* (2013.01); *B65D 51/2857* (2013.01); *B65D 51/2864* (2013.01); *B65D 75/527* (2013.01); *B65D 75/56* (2013.01)

(58) Field of Classification Search

CPC . B65D 81/3266; B65D 25/08; B65D 51/2864; B65D 21/2857; B65D 75/527; B65D 75/56

USPC ..... 206/219–221, 461, 568; 222/94, 95, 107

See application file for complete search history.

(56) References Cited

U.S. PATENT DOCUMENTS

| | | | | |
|---|---|---|---|---|
| 4,805,767 | A * | 2/1989 | Newman | B65D 81/3266 206/219 |
| 5,492,219 | A * | 2/1996 | Stupar | B65D 81/3266 206/219 |
| 7,935,101 | B2 * | 5/2011 | Muramatsu | B65D 81/3266 206/219 |
| 8,056,726 | B2 * | 11/2011 | Huff | B65B 29/10 206/221 |
| 2004/0078023 | A1 * | 4/2004 | Gollier | B65D 81/3266 206/215 |

(Continued)

FOREIGN PATENT DOCUMENTS

| | | |
|---|---|---|
| JP | 09-216664 | 8/1997 |
| JP | 2006-116100 | 5/2006 |

(Continued)

*Primary Examiner* — Luan K Bui

(74) *Attorney, Agent, or Firm* — Lex IP Meister, PLLC

(57) ABSTRACT

Disclosed is a dual compartment pouch with a pressure-openable non-seamed line with a configuration in which: a specific portion of a bonding line forms a border of first and second receiving portions; a pressurized opening formed with a cross-section of protrusions and depressions closely attached to upper sides or lower sides of one of the first and second receiving portions having a sealed external portion along an external bonding line and partitioned by an internal bonding line is disposed; and a cutting line for defining a range within which the first receiving portion and the second receiving portion may be separated from a lower side in the center of the internal bonding line to a position that is near the pressurized opening.

4 Claims, 6 Drawing Sheets

(56) References Cited

U.S. PATENT DOCUMENTS

| | | | | |
|---|---|---|---|---|
| 2004/0079763 | A1 | 4/2004 | Powell | |
| 2008/0149526 | A1* | 6/2008 | Sivakumar | A47L 13/17 206/568 |
| 2010/0140119 | A1* | 6/2010 | Katsuki | B65D 81/3266 206/219 |
| 2011/0100844 | A1* | 5/2011 | Cimaglio | B65D 81/3266 206/219 |
| 2014/0004227 | A1* | 1/2014 | Tran | A45D 37/00 206/219 |

FOREIGN PATENT DOCUMENTS

| | | |
|---|---|---|
| JP | 2014-073857 | 4/2014 |
| KR | 10-2011-0086450 | 7/2011 |
| KR | 20-0456298 | 10/2011 |
| KR | 10-1226739 | 1/2013 |

* cited by examiner

DUAL COMPARTMENT POUCH HAVING PRESSURE-OPENABLE NON-SEAMED LINE

CROSS-REFERENCE TO RELATED APPLICATION

This application claims priority to and the benefit of Korean Patent Application No. 10-2014-01 47753 filed in the Korean Intellectual Property Office on Oct. 28, 2014, the entire contents of which are incorporated herein by reference.

BACKGROUND OF THE INVENTION (a) Field of the Invention

The present invention relates to a dual compartment pouch with two receiving portions for receiving two types of contents, and particularly relates to a dual compartment pouch with a pressure-openable non-seamed line for mixing two types of received contents before opening the same.

(b) Description of the Related Art

A pouch with a receiving portion separated from the outside by thermally compressing two sheets of film has a characteristic of being easily processed to have a predetermined form while guaranteeing excellent waterproofness and air-tightness so it is generally used for packing liquid detergents, astringents, medicines, or drinks.

Conventionally, the pouch is used to contain liquid, powder, or solids of a single ingredient, but in a like a manner of the duplex storage pouch disclosed in Patent Document 1, in a pouch with a configuration in which liquids with different ingredients, or liquid and powder, are received in a pouch in a separate manner, when they are in use, one side of the separated receiving portion is pressurized to connect between the two separated receiving portions and mix the contents that are separately stored before they are opened.

The published duplex storage pouch has a configuration in which a space between the two receiving portions is partitioned by a bonding line partitioned in a sawtooth shape, which signifies that when one of the receiving portions is pressurized from the outside, the pressure is applied to the apex of the bonding line in a sawtooth shape, and the apex is broken so the connection is generated, and this kind of pouch is efficient for packing the liquids such as a hair dye or oxidizer which have different viscosities and must be separately contained until they are used.

However, the duplex storage pouch describes that the user pressurizes the pouch to open a border between the partitioned receiving portions, but actually, the user has to inconveniently apply the pressure with a substantial force in order to open an area that is close to the apex. In other words, the pressure generated when the user presses the receiving portion does not gather at a specific point but is uniformly distributed into the entire internal portion of the receiving portion so when the user strongly pushes it down with an adult's force, a partial pressure applied to the apex of the bonding line is not as large as expected so the apex is not easily opened, which is a drawback.

To solve the problem of the conventional art, as disclosed in Patent Document 2, the present inventor has proposed a dual compartment pouch in which at least one small space in a triangular shape with an apex is included on the bonding line forming a border between the receiving portion that is divided into two portions so a specific part of the bonding line has weaker adhesiveness than other parts.

The dual compartment pouch proposed by the present inventor has a configuration in which a bonded area of the bonding line is substantially reduced at a specific part and is formed to be a weak portion with weak adhesiveness compared to adjacent portions, but when it is formed to be a weak portion, the user had to inconveniently apply the pressure in order to open the part, such that the problem is still unresolved.

The present inventor solved the problem of the above-described dual compartment pouch by proposing a dual compartment pouch disclosed in Patent Document 3.

The proposed dual compartment pouch is formed to have a configuration in which a pressurizing opening formed with a non-bonded portion having two non-seamed lines is disposed on an internal bonding line for dividing as two receiving portions so the two receiving portions are separated from each other with two non-seamed lines and the non-bonded portion therebetween, which allows opening when the non-seamed line and the non-bonded portion are sequentially opened by the pressure generated by pressurizing one receiving portion, and the two non-seamed lines that are installed before and after the non-bonded portion separate the two receiving portions while the pouch is stored.

When the two non-seamed lines are set to be very narrow regarding the above-described dual compartment pouch, the user has to push down the receiving portion strongly, and when they are set to be very wide, leakage occurs between the two receiving portions to cause quality changes of contents so it is not easy to define the standard of the non-seamed lines.

PRIOR ART DOCUMENTS

Patent Documents (Patent Document 1) U.S. Patent Laid-Open Publication No. 2004/0079763, FIG. 1

(Patent Documents 2) Korean Utility Model Registration 20-04562980000, FIG. 1

(Patent Documents 3) Korean Patent No. 10-012267390000, FIG. 1

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a dual compartment pouch configured for receiving portions that are separately formed to receive different ingredients of contents, and in detail, to provide a dual compartment pouch with a pressure-openable and non-seamed line for allowing close contact so that a pressurized opening formed between the two receiving portions may not generate leakage, and allowing a user to open the pressurized opening with a small amount of force thereby providing an easy to use configuration.

An exemplary embodiment of the present invention provides a dual compartment pouch with a pressure-openable non-seamed line, including: a first receiving portion and a second receiving portion having a sealed external portion along an external bonding line, and partitioned by an internal bonding line; a pressurized opening disposed to be closely attached to a cross-section with protrusions and depressions in a non-seamed manner between upper sides or lower sides of the first receiving portion and the second receiving portion; and a cutting line formed from a lower side of a center of the internal bonding line to a position that is near the pressurized opening, wherein a space between the first receiving portion and the second receiving portion is separated by the cutting line, and one of them is folded up to open the pressurized opening.

A narrow path may be further provided in a center of the pressurized opening so as to control contacting of the pressurized opening caused by a cross-section with protrusions and depressions.

A first buffer and a second buffer may be further formed among the first receiving portion, the pressurized opening, and the second receiving portion to attenuate a strong pressure applied from the outside.

Contents received by the first receiving portion and the second receiving portion are desirably charged with a range of 50-60% of a contained space.

The dual compartment pouch according to an embodiment of the present invention is appropriate for separately receiving two kinds of contents that are to be separately packed until they are used.

According to the dual compartment pouch according to an embodiment of the present invention, the pressurized opening between the first receiving portion and the second receiving portion always has a strong contact by the cross-section with protrusions and depressions contacting in a non-seamed manner so when a static load of a weight loaded from top to bottom is applied to the lower pouch during delivery or storage, the pressurized opening is not opened thereby preventing the contents from being leaked and spoiled.

According to the dual compartment pouch according to an embodiment of the present invention, the cross-section with protrusions and depressions of the pressurized opening has an effect of preventing leakage according to an improvement of contacting and also prevents slipping when the users rubs it with his hands to relax it and to surface-separate it.

According to the dual compartment pouch according to an embodiment of the present invention, the gap between the receiving portions may be separated within the range allowable by the cutting line of the internal bonding line so the pressurized opening may be opened by folding one of the receiving portions from the lower portion, thereby easily and conveniently mixing the contents before it is opened.

According to the dual compartment pouch according to an embodiment of the present invention, the narrow path of the pressurized opening has a flat contacting side and its contacting is weaker than the cross-section with neighboring protrusions and depressions, so the contacting of the pressurized opening may be controlled to be weak by using such a characteristic.

According to the dual compartment pouch according to an embodiment of the present invention, when the first receiving portion or the second receiving portion is pushed down to substantially increase the internal pressure, the first buffer and the second buffer are provided as an attenuation space to control the pressure to be less than the pressure opening the pressurized opening and thus prevent sudden opening.

According to the dual compartment pouch according to an embodiment of the present invention, when the liquid content received by the first receiving portion and the second receiving portion is charged with 50-60% of the containable volume, the flow of content through the pressurized opening that is opened when the user separates the receiving portions and folds one of them up becomes fluent and it becomes easy to mix the same.

DETAILED DESCRIPTION OF THE EMBODIMENTS

The present invention will now be described in detail with an exemplary embodiment with reference to accompanying drawings.

Figure 1:
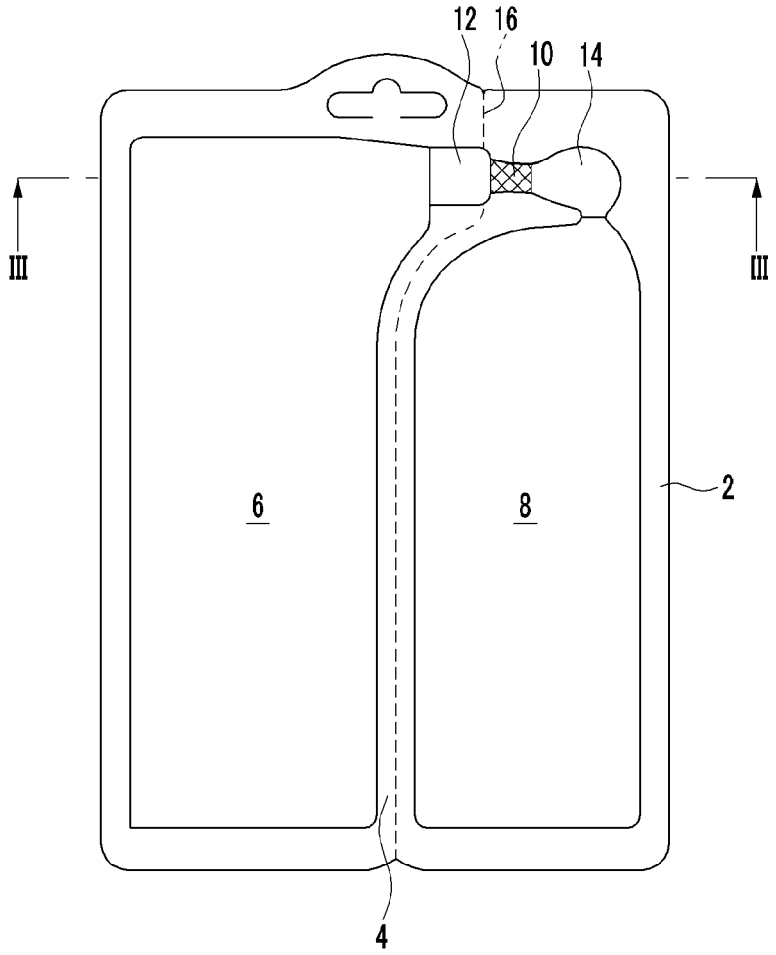
FIG. 1 shows a dual compartment pouch according to an exemplary embodiment of the present invention.

As shown in FIG. 1, a dual compartment pouch according to an embodiment of the present invention includes a first receiving portion 6 and a second receiving portion 8 sealed to form an external portion by an external bonding line 2 for thermally bonding an edge and individually partitioned by formation of an internal bonding line 4 to substantially traverse a center portion.

Liquid contents with different ingredients, in detail, two kinds of liquids, such as a hair dye and an oxidizer, that are not to be mixed before in use, two kinds of liquids, such as liquid vitamins, that may be deteriorated when they are mixed, one kind of powder and one kind of liquid, or a solid such as a nonwoven fabric mask and a liquid such as a facial cleansing water are contained in the first and second receiving portions 6 and 8 that are divided into two portions, and the space between the receiving portions 6 and 8 are allowed to be connected through a pressurized opening 10.

A first buffer 12 belonging to the first receiving portion 6 and a second buffer 14 belonging to the second receiving portion 8, although they may not be necessarily provided, may be provided on respective sides of the pressurized opening 10.

At a center of the internal bonding line 4, a cutting line 16 extends to a position that is near the pressurized opening 10 to separate the first receiving portion 6 and the second receiving portion 8 with a predetermined gap therebetween.

Differing from the external bonding line 2 and the internal bonding line 4 that are fused through a mold, the pressurized opening 10 and the buffers 12 and 14 are formed so that two sheets of film may touch each other and be adhered to each other in a non-welding manner in the present invention.

Figure 2:
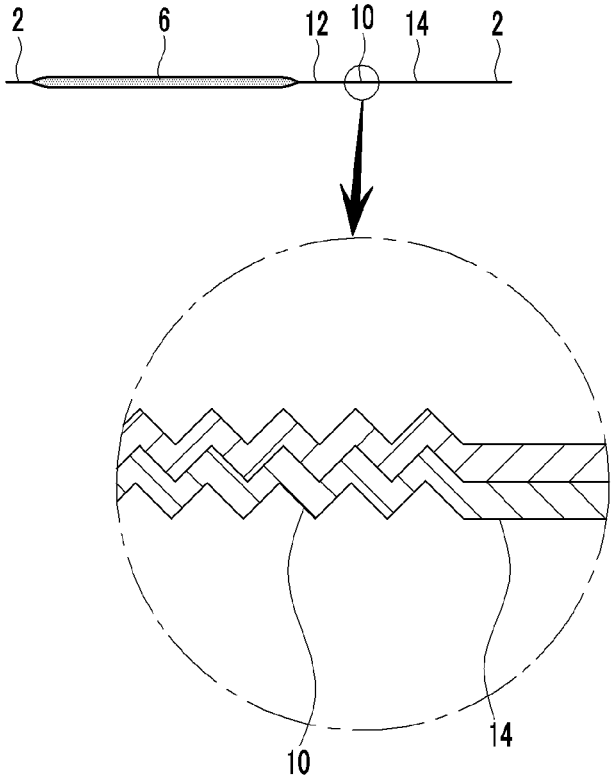
FIG. 2 shows a partial enlarged cross-sectional view of a pressurized opening with respect to a line III-III of FIG. 1.

Particularly, as shown in FIG. 2, when the pressurized opening 10 is pressurized by the mold, two sheets of film are installed to be bent and touch each other as protrusions and depressions in a cross-sectional view so an area where the two sheets of film contact each other are sufficiently increased and they are adhered to each other strongly.

Further, the pressurized opening 10 may be better disposed between upper sides or lower sides on one portion of the receiving portions 6 and 8, and because of the disposal, the receiving portions 6 and 8 and the pressurized opening 10 are connected in an orthogonal direction.

The pressurized opening 10 is opened by the pressure applied by one of the first receiving portion 6 and the second receiving portion 8, and in the case of the pouch in the shape shown in FIG. 1, it will be convenient to transfer the liquid stored in the second receiving portion 8 to the first receiving portion 6 and mix the same.

The pressurized opening 10 has a cross-section with protrusions and depressions to thus have sufficient bonding so it is opened when a substantial pressure is supplied from the outside, which may cause inconvenience to the user, but it may be easily opened with a small amount of pressure by rubbing an external surface of the pressurized opening 10 before its use to relax the gap between the cross-section of the protrusions and depressions and pressurize the second receiving portion 8.

Figure 3:
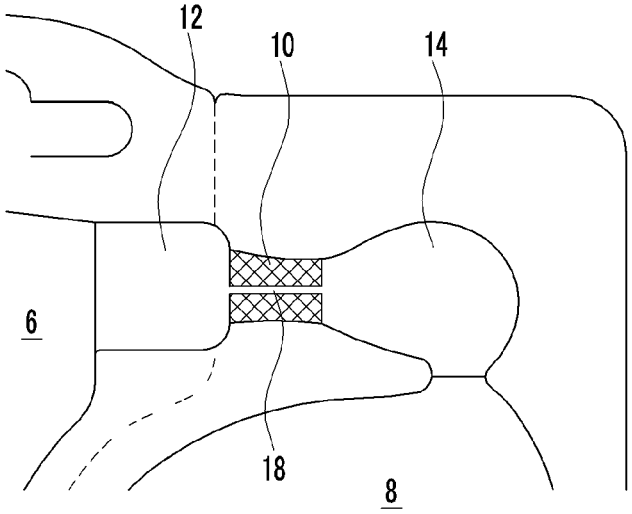
FIG. 3 shows a partial enlarged diagram of a pressurized opening of a dual compartment pouch according to an exemplary variation of the present invention.

FIG. 3 shows an exemplary variation on the pressurized opening 10, showing a configuration in which a narrow path 18 is formed in a center of the pressurized opening 10.

The narrow path 18 is provided as sides touching each other in a flat and non-seamed manner in the present invention so when the user rubs the pressurized opening 10, or an internal pressure of the receiving portion is applied to the pressurized opening 10, the narrow path 18 is surface-separated prior to the cross-section with protrusions and depressions having strong contact and is relaxed to be opened with a small amount of pressure. The narrow path 18 may be applicable to the case when the contact of the pressurized opening 10 is to be a little reduced.

Figure 4:
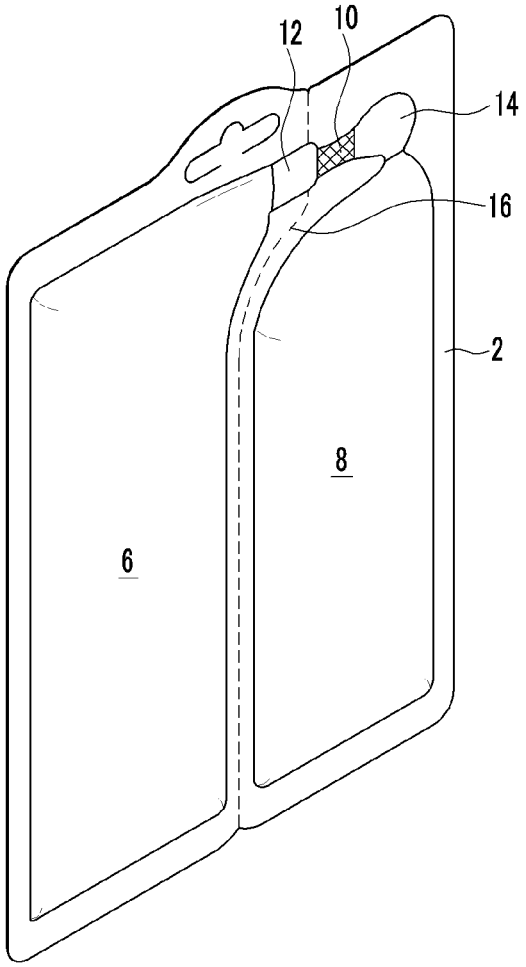
FIG. 4 shows a perspective view for indicating a state in which two types of liquids are separately contained in a dual compartment pouch according to an exemplary embodiment of the present invention.

As shown in FIG. 4, regarding the dual compartment pouch according to an embodiment of the present invention, when different liquid contents are separately contained in the first receiving portion 6 and the second receiving portion 8, it is desirable to control charged amounts of the receiving portions 6 and 8 to be 50-60% of the contained space in consideration of an increase of volume in a mixing process for transferring the entire contents of one side to the other side.

While the dual compartment pouch is stored as a bundle pack or being delivered, a static load applied as a sum of weights in the top direction when the pouch is loaded in a top to bottom direction is frequently applied to a lower pouch. However, the increase of pressure by the static load is absorbed and attenuated by the first buffer 12 or the second buffer 14 to prevent the pressurized opening 10 from undesirably being opened while being delivered or stored, so the two types of contents may be divided and observed in a secure manner.

Figure 5:
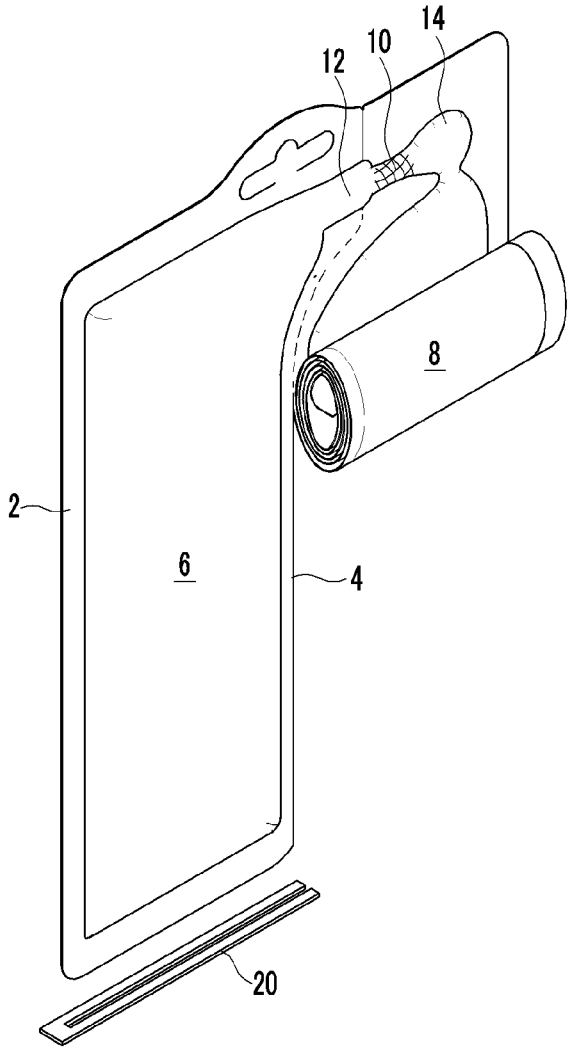
FIG. 5 shows a used state diagram for indicating a process for mixing contents contained in a dual compartment pouch according to an exemplary embodiment of the present invention.

When the pressurized opening 10 is to be opened, the user rubs an external portion of the pressurized opening 10 with a finger to surface-separate the contacted internal side, divides the receiving portions 6 and 8 along the cutting line 16 of the internal bonding line 4, and as shown in FIG. 5, folds the second receiving portion 8.

The further the fold of the second receiving portion 8, the more the liquid content therein passes through the second buffer 14 and gathers toward the pressurized opening 10, and the pressure of the content applied thereto is gradually increased. When the gradually increasing internal pressure reaches a predetermined level, the pressurized opening 10 is opened and the two kinds of contents transferred to the first receiving portion 6 start being mixed.

In addition, when the first receiving portion 6 instead of the second receiving portion 8 is folded, the flowing directions are different but the opening operation and the mixing are performed in a like manner.

As described, the configuration enabling one of the receiving portions to be folded may increase the internal pressure over a predetermined level so it is optimal to easily open the pressurized opening 10.

An example of mixing the contents that are separately stored in the first receiving portion 6 and the second receiving portion 8 is not limited to the above-noted folding of one of the receiving portions, and when it is inserted into an exclusive extruder 20, pushed up, and folded to transfer the contents, the respective contents may be mixed through the pressurized opening 10 in a like manner.

Figure 6:
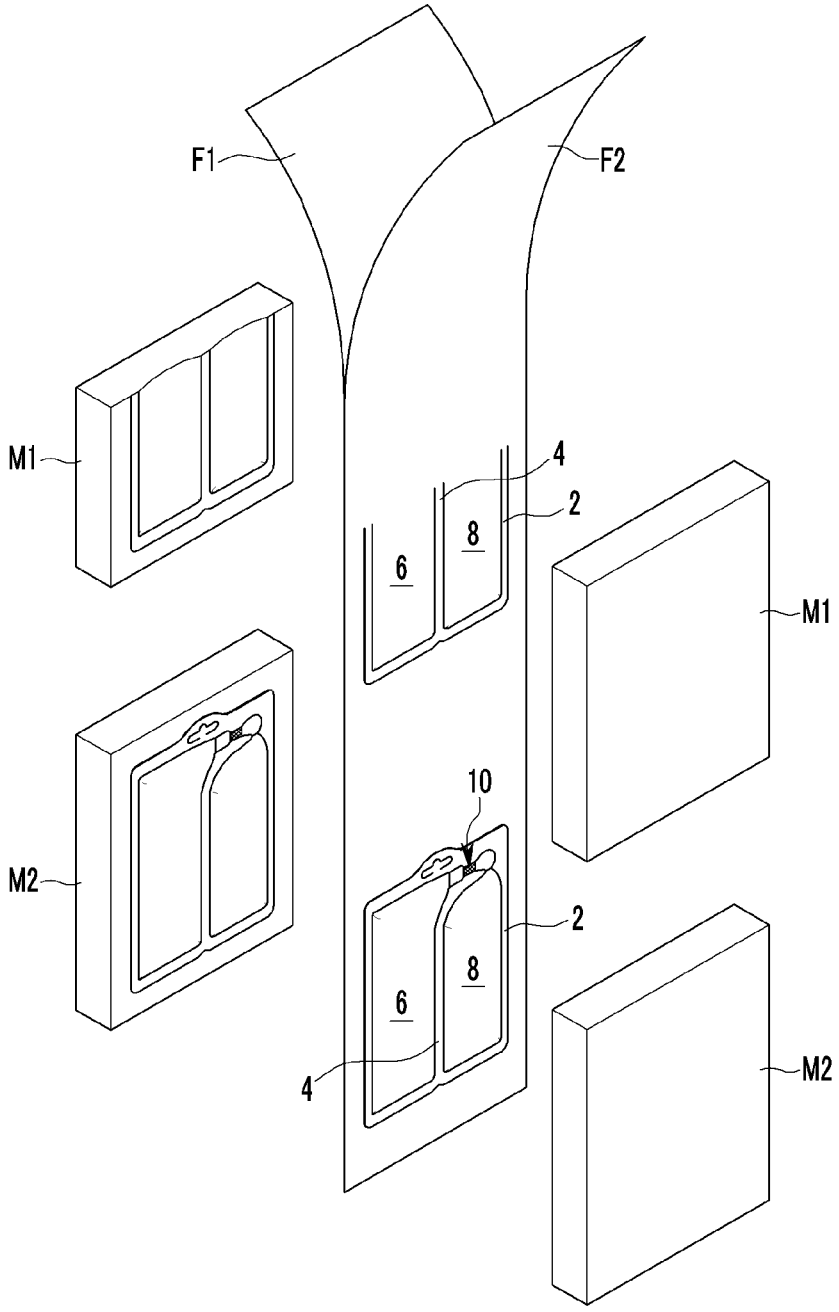
FIG. 6 shows a manufacturing method for realizing a dual compartment pouch according to an exemplary embodiment of the present invention.

The above-configured dual compartment pouch according to an embodiment of the present invention may be obtained by a manufacturing process shown in FIG. 6.

Referring to FIG. 6, two sheets of film F1 and F2 supplied as overlapped ones to form a pouch are pressed by a first mold M1 during transfer, and an external bonding line 2 and an internal bonding line 4 in a bottom direction and a vertical direction are heated by a heater, melted, pressurized, and integrally fused.

Two kinds of contents are injected therein through a nozzle (not shown), they are pressed by a secondary mold M2, a pressurized opening 10 (together with first and second buffers and a narrow path when they are provided) is formed, and an upper side is sealed through fusion, thereby forming a dual compartment pouch according to an embodiment of the present invention.

Further, a heater is not provided to a portion corresponding to the pressurized opening 10 (together with first and second buffers and a narrow path when they are provided) in the secondary mold M2, so the pressurized opening 10 passing through the same is compressed while no heat is applied, and the sides are closely adhered to each other in a non-seamed manner.

What is claimed is:

1. A dual compartment pouch with a pressure-openable non-seamed line, comprising:

a first receiving portion and a second receiving portion having a sealed external portion along an external bonding line, and partitioned by an internal bonding line;

a pressurized opening disposed to be closely attached to a cross-section with protrusions and depressions in a non-seamed manner between upper sides or lower sides of the first receiving portion and the second receiving portion; and a cutting line formed from a lower side of a center of the internal bonding line to a position that is near the pressurized opening, wherein a space between the first receiving portion and the second receiving portion is separated by the cutting line, and one of them is folded up to open the pressurized opening.

2. The dual compartment pouch of claim 1, wherein contacting of the pressurized opening is controlled to be low by further forming a narrow path in a center of the pressurized opening.

3. The dual compartment pouch of claim 1, wherein a first buffer and a second buffer are further formed among the first receiving portion, the pressurized opening, and the second receiving portion to attenuate a strong pressure applied from the outside.

4. The dual compartment pouch of claim 1, wherein contents received by the first receiving portion and the second receiving portion are charged with a range of 50-60% of a contained space.

* * * * *